US005472339A

United States Patent [19]

Rakowski et al.

[11] Patent Number: 5,472,339

[45] Date of Patent: Dec. 5, 1995

[54] NOX REDUCTION DEVICE

[75] Inventors: Mark R. Rakowski, Frisco; John W. Whitesitt, The Colony, both of Tex.; John H. Wiker, Plainfield, Ill.

[73] Assignee: Lennox Industries Inc., Dallas, Tex.

[21] Appl. No.: 282,881

[22] Filed: Jul. 29, 1994

[51] Int. Cl.[6] ..... F23M 9/06

[52] U.S. Cl. ..... 431/171; 126/110 R; 431/351

[58] Field of Search ..... 431/171, 353, 431/351; 126/110 R, 99 A

[56] References Cited

U.S. PATENT DOCUMENTS

| | | | |
|---|---|---|---|
| 1,654,403 | 12/1927 | Blake | 431/171 |
| 2,959,215 | 11/1960 | Warnecke | 431/171 |
| 3,185,143 | 5/1965 | Wilson | 126/91 A |
| 3,938,948 | 2/1976 | Moore et al. | 431/171 |
| 4,867,673 | 9/1989 | Harrigill | 431/171 |
| 5,083,917 | 1/1992 | McCullough et al. | 431/171 |
| 5,236,327 | 8/1993 | Flanagan et al. . | |
| 5,244,381 | 9/1993 | Cahlik . | |
| 5,333,597 | 8/1994 | Kirkpatrick et al. | 126/110 R |
| 5,370,529 | 12/1994 | Lu et al. . | |

*Primary Examiner*—Carroll B. Dority
*Attorney, Agent, or Firm*—W. Kirk McCord

[57] ABSTRACT

A device for inhibiting NOx production is disposed in a gas furnace combustion chamber. The device includes a baffle member for dividing the combustion chamber into first and second regions. A fuel-rich mixture of gas and primary combustion air is ignited by an inshot burner and the flame is drawn into the combustion chamber by an induced draft blower along with secondary combustion air. The combustion chamber is configured such that in the first region (i.e., upstream of the baffle member) turbulent mixing of the secondary combustion air with the flame is inhibited to maintain a relatively gas-rich flame. The baffle member channels the flame and secondary combustion air into a convergent flow path and the passage of the flame and secondary combustion air over the baffle member creates turbulence, which enhances mixing between the flame and secondary combustion air in the second region of the combustion chamber (i.e., downstream of the baffle member). The turbulent mixing effects substantially complete combustion of the gas/air mixture. Because the turbulent mixing occurs at a location farther along the flame path in the combustion chamber than in conventional gas furnaces, the flame temperature remains relatively low throughout the combustion chamber, thereby inhibiting NOx production.

15 Claims, 2 Drawing Sheets

NOX REDUCTION DEVICE

TECHNICAL FIELD

This invention relates generally to gas furnaces and in particular to apparatus for reducing NOx emissions in a gas furnace.

BACKGROUND ART

The formation of nitrous oxide (NOx) occurs when nitrogen is oxidized during the burning of a gaseous fuel. The higher the flame temperature, the greater amount of NOx is produced by the burner flame. Air quality standards in some states (e.g., California) require that NOx emissions from gas furnaces not exceed 40 nanograms per Joule (ng/J).

Devices for reducing NOx emissions in a gas furnace are known in the art. Such devices typically include a target or impingement device, located just inside the combustion chamber in proximity to the furnace burner, for quenching the flame and reducing the temperature thereof. One such apparatus is described in U.S. Pat. No. 5,244,381.

DISCLOSURE OF INVENTION

In accordance with the present invention, a device for lowering NOx emissions from a gas furnace is provided. The furnace has a combustion chamber with an inlet and an outlet, a burner proximate to the inlet for burning a combustible mixture of gas and primary combustion air to produce a relatively gas-rich flame, and a blower for drawing the gas-rich flame along with secondary combustion air into and through the combustion chamber. The device includes a baffle positionable within the combustion chamber for mixing the flame and secondary combustion air to enhance combustion of the gas. The baffle is located in the combustion chamber a predetermined distance from the inlet to maintain the relatively gas-rich flame along a sufficient length of the combustion chamber to prevent NOx emissions from exceeding a predetermined level.

In accordance with one feature of the invention, the baffle is oriented at an obtuse angle relative to the direction of flow of the incoming flame and secondary combustion air. In the preferred embodiment, the device further includes an elongated arm member and a mounting bracket. The mounting bracket depends from one end of the arm member and the baffle extends from an opposite end of the arm member. The device is insertable in the combustion chamber with the mounting bracket external thereto for mounting the device with a vestibule panel supporting the combustion chamber. The arm member is in contact with a substantially cylindrical wall defining the combustion chamber. The end of the arm member from which the mounting bracket depends is substantially coincident with the combustion chamber inlet such that the length of the arm member corresponds to the predetermined distance between the combustion chamber inlet and the baffle. When the device is positioned within the combustion chamber, the baffle is oriented at an obtuse angle with respect to a major axis of the arm member as well as with respect to the direction of flow of the incoming flame and secondary combustion air.

In operation, the gas-rich flame produced by the burner is drawn into the combustion chamber along with secondary combustion air. The path of the flame and secondary combustion air upstream of the baffle is characterized by a substantially laminar flow such that the flame remains relatively gas-rich and the flame temperature is sufficiently low to inhibit excessive NOx production. There is insufficient mixing between the secondary combustion air and the flame to provide complete combustion of the gas.

The baffle alters the flow of the flame and secondary combustion air by causing the flame and secondary combustion air to converge such that the flame and secondary combustion air are mixed. Further, as the flame and secondary combustion air pass over the baffle, turbulence is imparted to the flow, thereby further enhancing the mixing action. Mixing the secondary combustion air with the flame enhances the combustion process such that complete combustion of the gas occurs downstream of the baffle. The predetermined distance between the combustion chamber inlet and the baffle is selected to maintain the relatively gas-rich flame along a sufficient length of the combustion chamber to prevent NOx emissions from exceeding a predetermined level.

Therefore, in accordance with the present invention, NOx emissions from a gas furnace are reduced without using a target or impingement device to quench and reduce the temperature of a gas flame in which complete combustion (i.e., mixing of the flame with secondary combustion air) has already substantially occurred.

BEST MODE FOR CARRY OUT THE INVENTION

Figure 1:
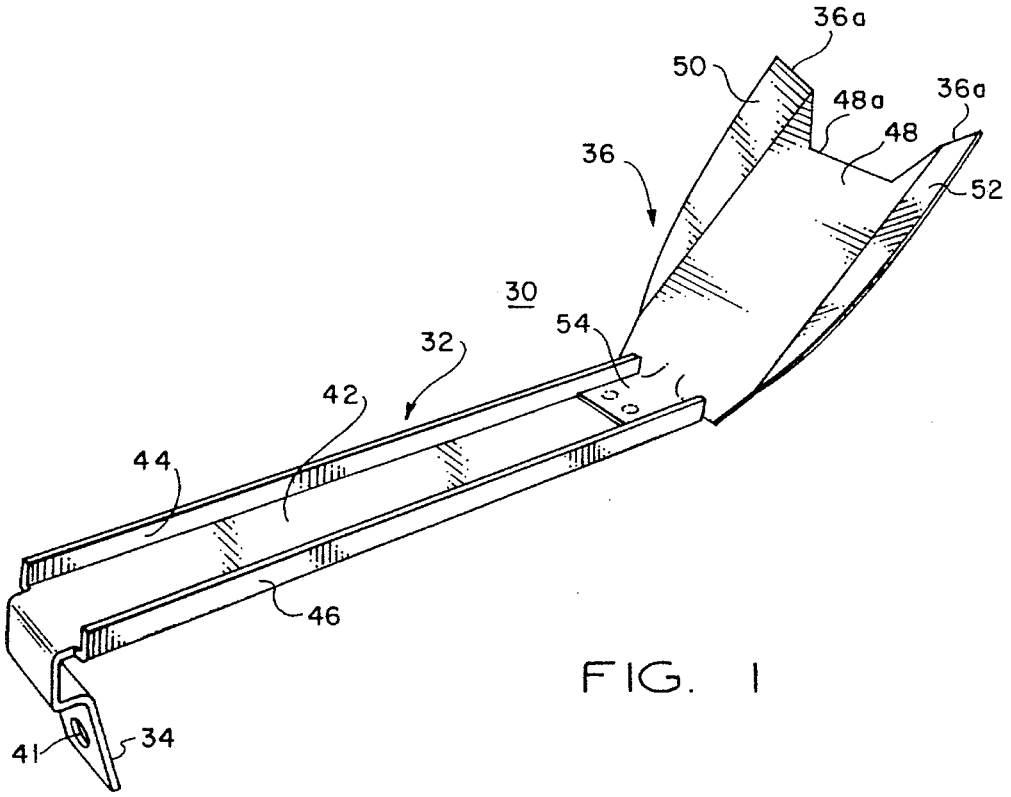
FIG. 1 is a perspective view of a device for reducing NOx emissions from a gas furnace, according to the present invention.

The best mode for carrying out the invention is described hereinbelow with reference to the accompanying drawings. Like parts are marked throughout the specification and drawings with the same respective reference numbers. The drawings are not necessarily to scale and in some instances proportions may have been exaggerated in order to more clearly depict certain features of the invention.

Referring to FIGS. 1–4, an inshot burner 10 and combustion chamber 12 of a gas furnace 13 are depicted. Burner 10 includes a flared inlet end 14 and a hollow body portion 16 in the shape of a truncated cone, the apex of which is proximate to inlet end 14 and the base of which defines an outlet end 18 of burner 10.

Inlet end 14 is in fluid communication with a source (not shown) of combustible gas and primary combustion air. A combustible mixture of gas (e.g., natural gas) and primary combustion air enters burner 10 at inlet end 14 and exits burner 10 at outlet end 18. A conventional igniter, such as a spark igniter (not shown), ignites the combustible gas/air mixture emanating from outlet end 18 in a gap 20 between outlet end 18 and an inlet opening 22 of combustion chamber 12.

Inlet opening 22 is generally circular with a diameter of approximately 2–⅜ inches. Combustion chamber 12 is defined by a wall 24. Wall 24 is tapered outwardly from inlet opening 22 to an intermediate position 26, where the combustion chamber 12 is oval-shaped, with a minor dimension of approximately 2–½ inches and a major dimension of approximately 5 inches.

The ignition of the gaseous fuel and the primary combustion air in gap 20 produces a fuel-rich flame, which is drawn through inlet opening 22 into combustion chamber 12 along with secondary combustion air. The outwardly tapered portion of wall 24 extending from inlet opening 22 to intermediate position 26 enhances the laminar flow of the flame and secondary combustion air and inhibits turbulent mixing of the secondary combustion air with the flame. The flame and secondary combustion air are preferably drawn into and through combustion chamber 12 by a conventional induced draft blower 28.

In accordance with the present invention, a device 30 for inhibiting NOx production is positionable in combustion chamber 12. Device 30 is substantially spoon-shaped and has an elongated arm member 32 of a predetermined length, a mounting bracket 34 depending from one end of arm member 32 and a baffle member 36 extending from an opposite end of arm member 32 at an obtuse angle of approximately 138° relative to a major axis of arm member 32. When device 30 is disposed in combustion chamber 12, bracket 34 is external thereto and arm member 32 and baffle member 36 are received in combustion chamber 12. The end of arm member 32 from which bracket 34 depends is substantially coincident with inlet opening 22 such that baffle member 36 is recessed into combustion chamber 12 by a distance substantially equal to the length of arm member 32. In one embodiment, arm member 32 is approximately 6–½ inches long such that baffle member 36 is recessed approximately 6–½ inches into combustion chamber from inlet opening 22.

Bracket 34 is mounted with a vestibule panel 38, which supports combustion chamber 12, to secure device 30 within combustion chamber 12. A conventional mounting member 40 (e.g., a screw or bolt) extends through a hole 41 in bracket 34 to affix bracket 34 to vestibule panel 38. Arm member 32 has a relatively flat base 42 and generally upstanding, opposed side walls 44 and 46, to define a generally U-shaped channel section. Baffle member 36 also has a relatively flat base 48 and first and second walls 50 and 52 extending upwardly and outwardly from respective opposite sides of base 48. Each wall 50, 52 intersects base 48 at an angle of approximately 134°. The width of each wall 50, 52 along its minor axis increases gradually until it reaches its maximum width adjacent distal end **36*a* of baffle member 36. The respective distal ends of walls 50 and 52 define distal end 36*a*. Distal end 48*a* of base 48 is configured in the shape of three sides of a trapezoid such that walls 50 and 52 extend beyond a major portion of base 48. A gusset 54 is integrally formed with baffle member 36 and is secured to arm member 32 to join baffle member 36 to arm member 32. Device 30 is preferably made of 20** gauge high temperature stainless steel.

Figure 2:
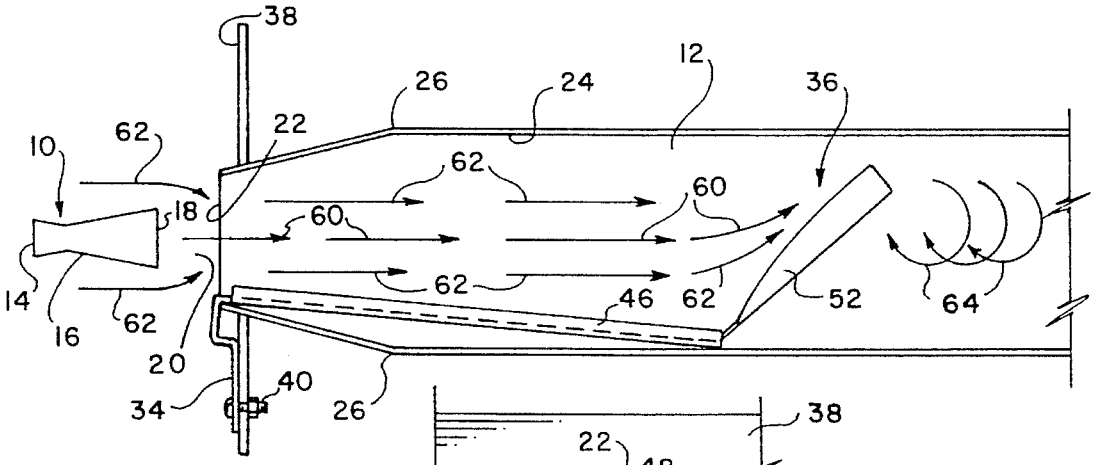
FIG. 2 is a side sectional view of a gas furnace burner and combustion chamber, with the device of FIG. 1 positioned in the combustion chamber, illustrating the operation of the device.
Figure 3:
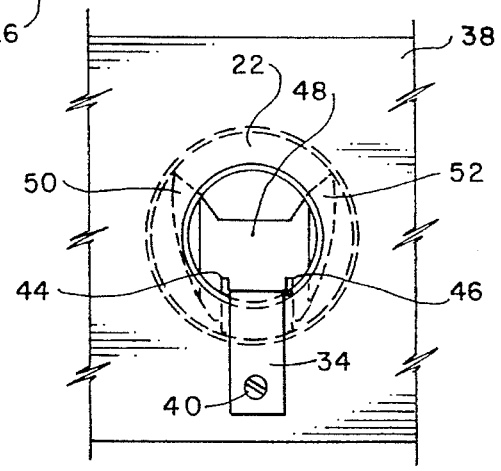
FIG. 3 is an external front elevation view of the burner and combustion chamber of FIG. 2, with the device of FIG. 1 positioned inside the combustion chamber.
Figure 4:
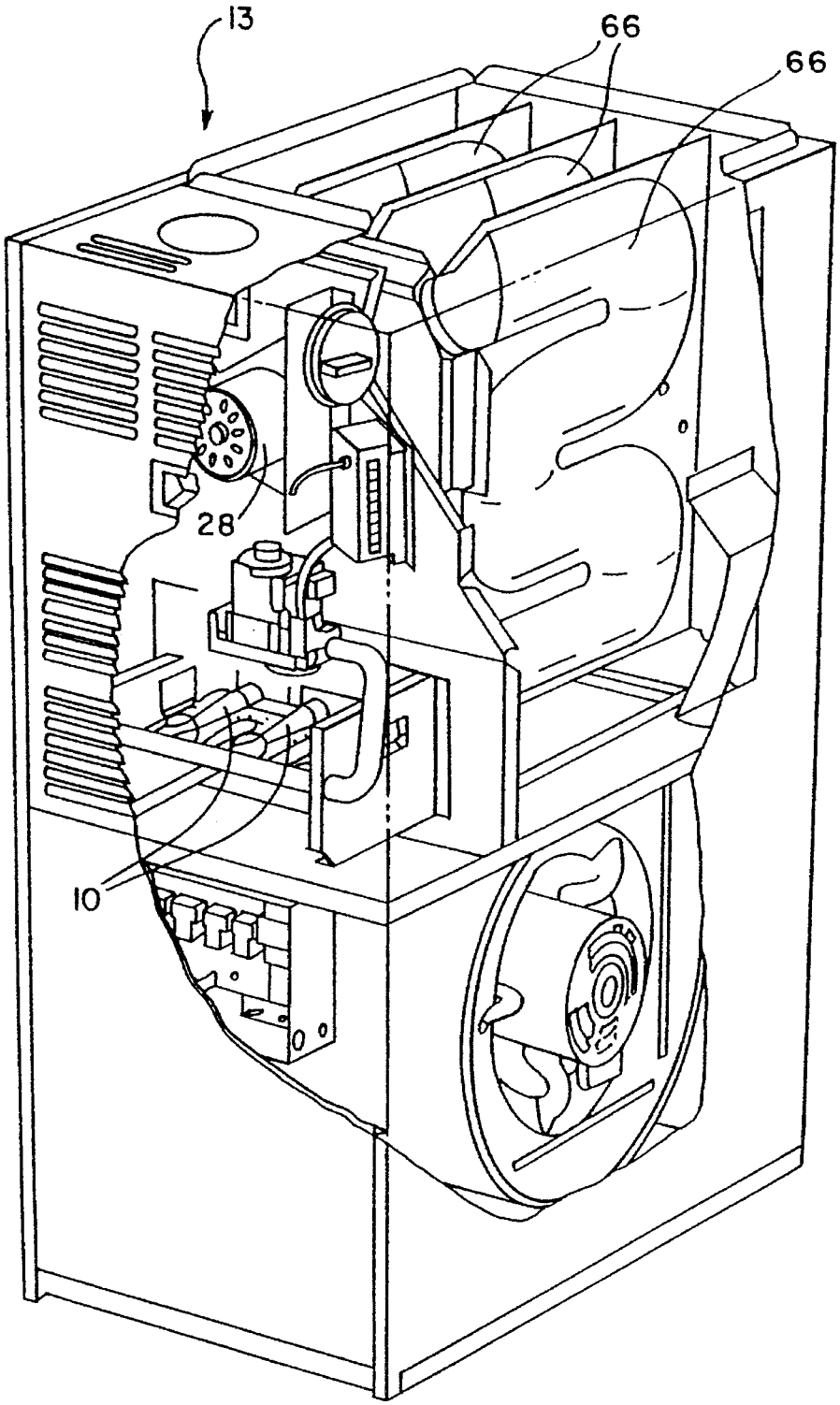
FIG. 4 is a perspective, partial cutaway view of a gas furnace containing the NOx emissions reduction device of the present invention.

In operation, baffle member 36 divides combustion chamber 12 into first and second regions, the first region being upstream of baffle member 36 and the second region being downstream thereof. In the first region, a relatively gastric gas/air mixture is burned at a relatively low temperature, thereby inhibiting NOx production. During this first stage of combustion, turbulent mixing between secondary combustion air and the flame is inhibited, such that complete combustion does not occur in the first region. The path of the flame in the first region is indicated by arrows 60 and the path of the secondary combustion air in the first region is indicated by arrows 62 as shown in FIG. 2. The tapered portion of combustion chamber 12 between inlet opening 22 and position 26 promotes laminar flow of the flame and secondary combustion air, to inhibit mixing of the flame and secondary combustion air.

When the flame and secondary combustion air encounter baffle member 36, base 48 and walls 50 and 52 cooperate to channel the flame and secondary combustion air into a convergent flow path, as shown in FIG. 2, such that the secondary combustion air mixes with the flame as the flame and secondary combustion air pass over baffle member 36. The mixing is enhanced by the turbulence resulting from the flame and secondary combustion air passing over baffle member 36. Baffle member 36 spans the width of combustion chamber 12 at distal end **36*a*, as can be best seen in FIG. 3. The turbulent mixing is indicated by arrows 64 in FIG. 2 and defines the second stage of combustion downstream of baffle member 36**, characterized by reduction of the gas/air ratio and substantially complete combustion of the gas/air mixture.

The flame is maintained relatively gas-rich on the upstream side of baffle member 36 to inhibit NOx production in the first region of the combustion chamber. Because complete combustion occurs farther along flame path in the combustion chamber 12 than in conventional gas furnaces, the flame temperature remains sufficiently low throughout combustion chamber 12 to maintain NOx production below an acceptable limit. The distance between inlet opening 22 and baffle member 36 may vary depending on the furnace capacity and other parameters. The distance should be selected to maintain the flame relatively gas-rich along a sufficient length of combustion chamber 12 to prevent NOx emissions from exceeding a predetermined level (e.g., 40 ng/J). The products of combustion are drawn out of combustion chamber 12 by induced draft blower 28 into a heat exchanger 66 of furnace 13. Heat exchanger 66 communicates with the combustion chamber outlet (not shown).

The effectiveness of device 30 in reducing NOx emissions has been determined through empirical testing. Testing of emissions from a 125,000 BTU/hour gas furnace with a NOx reduction device of the type described herein has indicated that NOx emissions are below the 40 ng/J threshold.

The best mode for carrying out the invention has now been described in detail. Since changes in and additions to the above-described best mode may be made without departing from the nature, spirit and scope of the invention, the invention is not to be limited to the above-described best mode, but only by the appended claims and their proper equivalents.

We claim:

1. In a gas furnace having an elongated combustion chamber with an inlet and an outlet, a burner for burning a combustible mixture of gas and primary combustion air to produce a relatively gas-rich flame spaced from and aligned with said inlet, and a blower for drawing the relatively gas-rich flame along with secondary combustion air at said inlet, into and through the combustion chamber, a device for lowering NOx emissions, said device comprising an elongated arm member of predetermined length, a bracket depending from one end of said arm member for mounting said device with a wall of the furnace and a baffle member ascending from an opposite end of said arm member at an obtuse angle with respect to a longitudinal axis of said and member, said device being located lengthwise in the combustion chamber with said bracket substantially coincident with the inlet, said longitudinal axis substantially parallel to an axis extending between the inlet and the outlet, and said baffle member located in the combustion chamber at a distance from the inlet substantially equal to said predetermined length.

2. The device of claim 1 wherein said arm member defines an elongated, substantially U-shaped channel.

3. The device of claim 1 wherein said baffle member has a relatively flat base and first and second walls extending upwardly and outwardly from respective opposed sides of said base.

4. The device of claim 1 wherein said predetermined length is approximately 6–½ inches.

5. In combination:

a gas furnace having an elongated combustion chamber with an inlet and an outlet, a burner for burning a combustible mixture of gas and primary combustion air to produce a relatively gas-rich flame spaced from and aligned with said inlet, and a blower for drawing the flame along with secondary combustion air at said inlet into and through said combustion chamber; and a device for lowering NOx emissions from said furnace, said device including a baffle located in said combustion chamber in line with said burner and being at an obtuse angle in the direction of said outlet at a predetermined distance from said inlet to maintain the flame relatively gas-rich along a sufficient length of said combustion chamber to prevent NOx emissions from the gas furnace from exceeding a predetermined level, said combustion chamber being outwardly tapered from said inlet to a predetermined position intermediate said inlet and said outlet, said tapered portion being adapted to enhance laminar flow of the flame and secondary combustion air upstream of said baffle, thereby inhibiting turbulent mixing between the secondary combustion air and the flame upstream of said baffle.

6. The combination of claim 5 wherein said baffle has a relatively flat base and first and second walls extending upwardly and outwardly from respective opposed sides of said base.

7. The combination of claim 5 wherein said device further includes an elongated arm member having a predetermined length and a bracket depending from one end of said arm member for mounting said device with said furnace, said baffle depending from an opposite end of said arm member at an obtuse angle with respect to a longitudinal axis of said arm member, said one end of said arm member being coincident with said inlet such that said predetermined length corresponds to said predetermined distance.

8. The combination of claim 7 wherein said predetermined length is approximately 6–½ inches.

9. The combination of claim 7 wherein said and member defines an elongated, substantially U-shaped channel.

10. In combination:

a gas furnace having an elongated combustion chamber with an inlet and an outlet, a burner for burning a combustible mixture of gas and primary combustion air to produce a relatively gas-rich flame spaced from and aligned with said inlet, and a blower for drawing the flame along with secondary combustion air, into and through said combustion chamber; and a device for lowering NOx emissions from said furnace, said device including an elongated arm member of predetermined length, a bracket depending from one end of said arm member for mounting said device with a wall of said furnace and a baffle member ascending from an opposite end of said arm member at an obtuse angle with respect to a longitudinal axis of said arm member, said device being located in said combustion chamber with said bracket substantially coincident with said inlet, said longitudinal axis substantially parallel to an axis extending between said inlet and said outlet, and said baffle member located in said combustion chamber at a distance from said inlet substantially equal to said predetermined length.

11. The combination of claim 10 wherein said arm member defines an elongated, substantially U-shaped channel.

12. The combination of claim 10 wherein said baffle member has a relatively flat base and first and second walls extending upwardly and outwardly from respective opposed sides of said base.

13. The combination of claim 10 wherein said predetermined length of said arm member is approximately 6–½ inches.

14. The combination of claim 10 wherein said baffle member is oriented at an obtuse angle relative to the direction of flow of the flame and secondary combustion air upstream of said baffle member.

15. The combination of claim 10 further including means for inhibiting mixing of the gas-rich flame and secondary combustion air upstream of said baffle member.

* * * * *